US011806597B1

(12) United States Patent
Truong

(10) Patent No.: US 11,806,597 B1
(45) Date of Patent: Nov. 7, 2023

(54) ALIGNMENT AID

(71) Applicant: SWINGWORKS GOLF INC., Hampton, GA (US)

(72) Inventor: Giam Truong, Hampton, GA (US)

( * ) Notice: Subject to any disclaimer, the term of this patent is extended or adjusted under 35 U.S.C. 154(b) by 0 days.

(21) Appl. No.: 17/869,668

(22) Filed: Jul. 20, 2022

(51) Int. Cl.
*A63B 69/36* (2006.01)
*A63B 69/00* (2006.01)

(52) U.S. Cl.
CPC ..... *A63B 69/3608* (2013.01); *A63B 69/0059* (2013.01)

(58) Field of Classification Search
CPC ..... A63B 69/3608; A63B 69/0059
USPC ..... 473/207, 212, 215, 216, 252
See application file for complete search history.

(56) References Cited

U.S. PATENT DOCUMENTS 4,398,201 A * 8/1983 Winegard ..... H01Q 19/30 343/815
5,085,437 A * 2/1992 Leitao ..... A63B 69/0059 473/212
5,529,306 A 6/1996 Staats et al.
5,569,095 A * 10/1996 McCollum ..... A63B 69/3608 446/28
5,658,203 A * 8/1997 Shub ..... A63B 69/0059 473/214
5,890,968 A * 4/1999 Mingo ..... A63B 69/0059 473/212
8,006,345 B1 * 8/2011 Bryce ..... E05D 11/1007 16/285
11,202,950 B2 12/2021 Russo
2003/0109320 A1 * 6/2003 Perry ..... A63B 69/3608 473/215
2009/0011846 A1 * 1/2009 Scott ..... A63B 69/3608 473/201
2011/0319184 A1 12/2011 Young
2017/0189783 A1 * 7/2017 Woodrow ..... F16M 11/046
2022/0008800 A1 1/2022 Weissinger et al.

FOREIGN PATENT DOCUMENTS

KR 20180070954 6/2018

OTHER PUBLICATIONS

Alignment Pro; Article entitled: "Alignment Pro Double Hinge Package", located at <https://www.alignmentpro.com/products/alignment-pro-alignment-stick, retrieved on May 27, 2022, 5 pgs.
Golf Feature; Article entitled: "Best Golf Alignment Sticks (2022)", available at <https://golffeature.com/best-golf-alignment-sticks/>, published Jan. 16, 2022, 30 pgs.

* cited by examiner

*Primary Examiner* — Nini F Legesse
(74) *Attorney, Agent, or Firm* — TAYLOR ENGLISH DUMA LLP

(57) ABSTRACT

An alignment aid includes a joint section, at least one central section connected to the joint section, at least one central section being hollow and defining at least one linear channel, at least one rider arranged within the at least one linear channel, each rider connected to an attachment mechanism.

10 Claims, 6 Drawing Sheets

ALIGNMENT AID

TECHNICAL FIELD

This disclosure relates to athletics. More specifically, this disclosure relates to sporting equipment.

BACKGROUND

In the game of golf, alignment is an important aspect of play. Players of the game can execute perfect motions to perform a golf swing, but if those players are not properly aligned then the resulting shots will not be propelled toward the desired target. Many times, players can be unaware of improper alignment.

SUMMARY

In one aspect of the current disclosure, an alignment aid includes a central section, the central section being linear; and an attachment mechanism connected to the central section.

In another aspect, an alignment aid includes a joint section; a first central section connected to the joint section, the first central section being hollow and defining a first linear channel; a second central section connected to the joint section, the second central section being hollow and defining a second linear channel; a first rider movably arranged within the first linear channel, the first rider connected to a first attachment mechanism; a second rider movably arranged within the second linear channel, the second rider connected to a second attachment mechanism; a first end section connected to the first central section; and a second end section connected to the second central section, wherein the joint section comprises a hinge.

In another aspect of the current disclosure, a method of using an alignment aid for aligning a golfer's body—the golfer wearing clothing—the method includes: obtaining an alignment aid, the alignment aid comprising: a joint section; a first central section connected to the joint section, the first central section being hollow and defining a first linear channel; a second central section connected to the joint section, the second central section being hollow and defining a second linear channel; a first rider movably arranged within the first linear channel, the first rider connected to a first attachment mechanism; and a second rider movably arranged within the second linear channel, the second rider connected to a second attachment mechanism; connecting the first attachment mechanism to a first portion of the golfer's clothing; connecting the second attachment mechanism to a second portion of the golfer's clothing; and, aligning the alignment aid toward a target.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is an alignment aid and associated methods, systems, devices, and various apparatus. The alignment aid includes various features to ensure its accuracy, ease of use, and portability among other features and design elements. No particular terminology or description should be considered limiting on the disclosure or the scope of any claims issuing therefrom.

Figure 1:
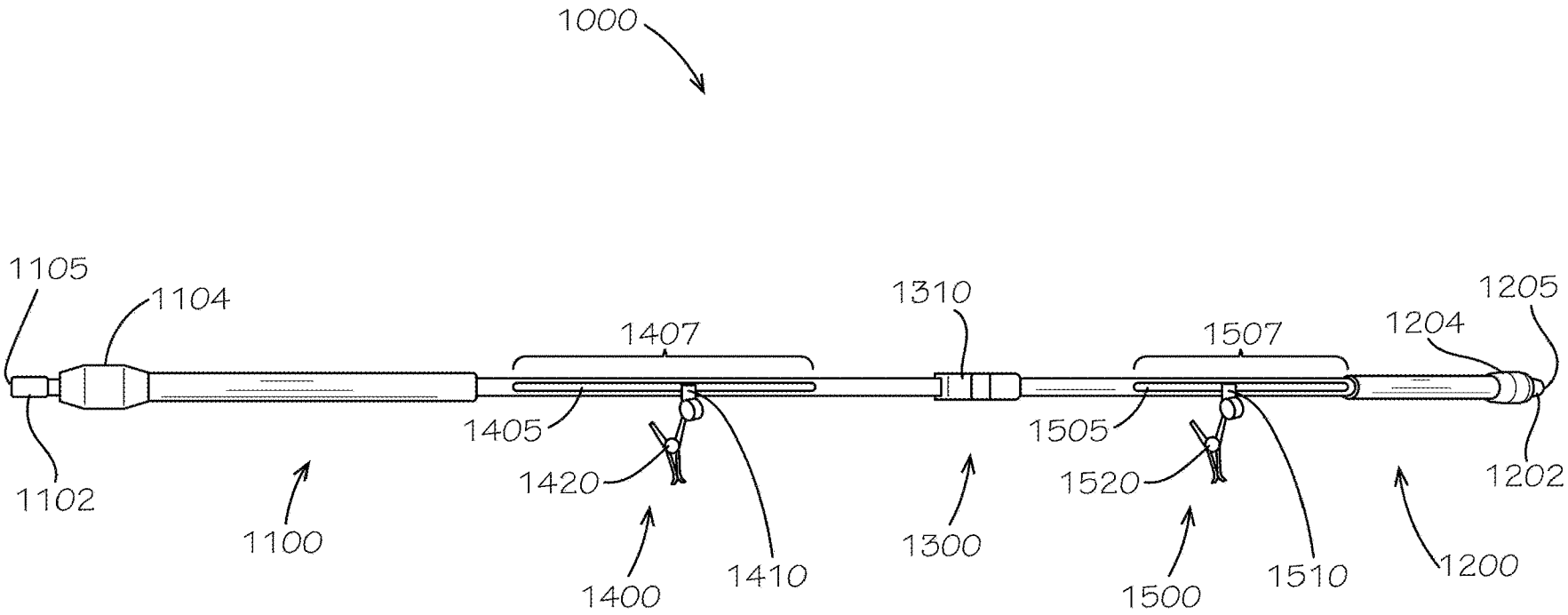
FIG. 1 is a side view of an alignment aid in accord with one aspect of the current disclosure in an opened arrangement.

One embodiment of an alignment aid 1000 is disclosed and described in FIG. 1. In the current aspect, the alignment aid 1000 can be a straight implement being of variant length. The alignment aid 1000 can be of cylindrical shape. The alignment aid 1000 can be of varying other shapes including extruded rectangle, extruded square, extruded triangle, conical, frustoconical, varying other shapes as one of skill in the art may readily understand, or combinations thereof. In the current aspect, the alignment aid 1000 can be telescoping cylinder. In varying aspects, the alignment aid 1000 can be hollow. In varying aspect, the alignment aid 1000 can be solid. In varying aspects, the alignment aid 1000 can be partially hollow. In varying aspects, the alignment aid 1000 can be of varying diameters and sizes to accommodate varying features that are included therewith.

The alignment aid 1000 can be of an array of materials. In the current aspect, the alignment aid 1000 can be formed of aluminum construction. In varying aspects, the alignment aid 1000 can be formed of steel, copper, brass, or composite. In varying aspects, the alignment aid 1000 can be formed of varying plastics, including but not limited to nylon, polyethylene (PE), polypropylene (PP), polyvinyl chloride (PVC), polystyrene, polyethylene terephthalate (PET), graphite, glass fiber, varying natural and synthetic rubbers, and varying other materials known to one of skill in the art. In varying aspects, the alignment aid 1000 can include multiple materials as appropriate for applications described herein.

The alignment aid 1000 can include multiple sections. The alignment aid 1000 can include at least one end section. In the current aspect, the alignment aid 1000 can include a first end section 1100 and a second end section 1200. In the current aspect, the alignment aid 1000 can include a central joint section 1300. In varying aspects, the central joint section 1300 can be omitted. In the current aspect, the alignment aid 1000 can include a first central section 1400 and a second central section 1500. The arrangement of the alignment aid 1000 can include the first end section 1100 connected to the first central section 1400, the first central section 1400 connected to the central joint section 1300, the central joint section 1300 connected to the second central section 1500, and the second central section 1500 connected to the second end section 1200. Although the current aspect can include the aforementioned sections (1100, 1200, 1300, 1400, 1500), no particular arrangement of sections (1100, 1200, 1300, 1400, 1500) should be considered limiting on the scope of the current disclosure. Additionally, various sections (1100, 1200, 1300, 1400, 1500) can be omitted in various aspects of the current disclosure.

When arranged in an opened arrangement as seen in FIG. 1, the alignment aid 1000 can be straight and sufficiently rigid to be pointed at a target without bending or collapsing. As such, the alignment aid 1000 can provide a visual guide for a straight line toward a target. Various aspects can include various configurations not otherwise explicitly described herein but as would be understood to one of skill in the art as desirable.

In the current aspect, each end section 1100, 1200 can be hollow to accommodate an end element 1102, 1202. In the current aspect, each end element 1102, 1202 can be telescoping. Each end section 1100, 1200 can comprise a pole clamp 1104, 1204. In various aspects, each pole clamp 1104, 1204 can be of varying arrangements known to one of skill in the art. Each pole clamp 1104, 1204 can be a mast clamp. Each pole clamp 1104, 1204 can be a truss clamp. Each pole clamp 1104, 1204 can be a ring clamp. In the current aspect, each pole clamp 1104, 1204 can be a threaded compression clamp. Various aspects of pole clamps can be utilized to connect each end element 1102, 1202 in moveably fixable relation to one end section 1100, 1200. In various aspects, a tip 1105, 1205 can be attached to each end element 1102, 1202. In various aspects, the tip 1105, 1205 can be rubber, plastic, metal, cork, wood, or various other materials.

Figure 2:
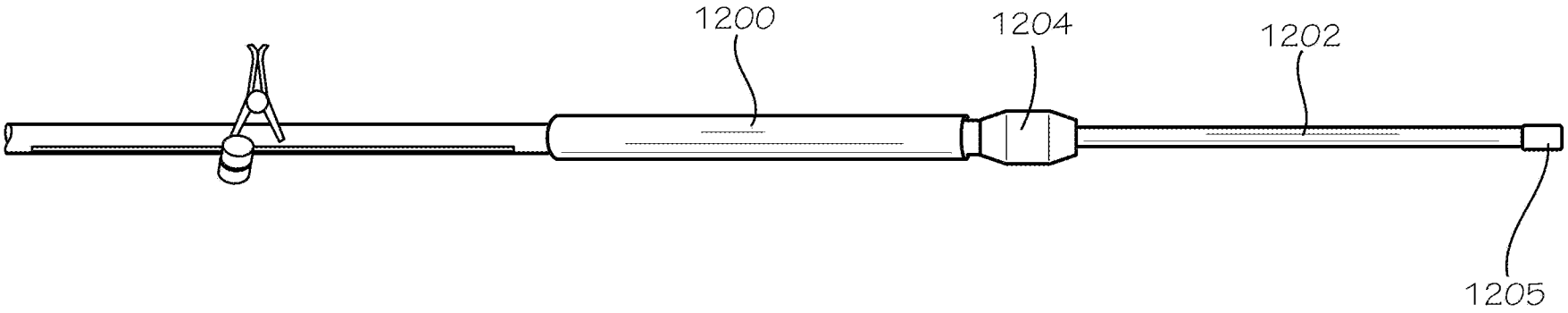
FIG. 2 is a detail view of an end section of the alignment aid of FIG. 1.

As seen with reference to FIG. 2, the end element 1202 can be extended out of the end section 1200. When extended to a desired length, the pole clamp 1204 can be actuated to fix the end element 1202 in relation to the end section 1200. Such an arrangement allows the alignment aid 1000 to expand and to contract in size to accommodate various applications. End element 1102 can similarly be extended with reference to end section 1100 and fixed in place with pole clamp 1104, although not shown in the current figure.

With returning reference to FIG. 1, each central section 1400, 1500 can define a linear channel 1405, 1505. In the current aspect, each linear channel 1405, 1505 can be of a fixed width defined along the axis of each central section 1400, 1500. Each linear channel 1405, 1505 can be defined along a length 1407, 1507 of one central section, 1400, 1500. Each length 1407, 1507 can be of varying measurements. In the current aspect, each length 1407, 1507 is about six inches. Various aspects can define various lengths. In various aspects, each linear channel 1405, 1505 can be defined along the entire length of one central section 1400, 1500. In various aspects, each length can be less than two inches. In various aspects, the linear channels 1405, 1505 can be of minimal length essentially allowing no translation. In various aspects, the linear channels 1405, 1505 can be simply a hole. In various aspects, the linear channels 1405, 1505 can be omitted in favor of other attachment mechanisms as would be understood by one of skill in the art.

A rider 1410, 1510 can be aligned within each linear channel 1405, 1505. In the current aspect, the rider 1410, 1510 can be arranged to move linearly along the axis of one central section 1400, 1500 within one linear channel 1405, 1505. In varying aspects, the rider 1410, 1510 can be omitted. In varying aspects, other mechanisms can be utilized to perform the function of a movable rider, including magnets, Velcro, elastic, key/fit arrangements, and various other mechanical approaches known to one of skill in the art. No specific arrangement of adjustability should be considered limiting on the scope of the disclosure. In aspects in which the joint 1310 is omitted from the design, a single linear channel can be defined in various aspects. In various aspects, multiple linear channels can be defined in the central sections 1400, 1500 even if the joint 1310 is omitted. In various aspects, more than one rider 1405, 1505 can be arranged within a single linear channel 1405, 1505. In various aspects including only a single linear channel, a single rider 1410, 1510 or multiple riders 1410, 1510 can be arranged within the single linear channel. In various aspects, the riders 1410, 1510 can be clamps that can be releasably fixed in locations along the channel 1410, 1510.

An attachment mechanism 1420, 1520 can be connected to each rider 1410, 1510. In the current aspect, each attachment mechanism 1420, 1520 is a spring clamp—or in varying terms, a banana clamp. Various attachment mechanisms are considered within the scope of the current disclosure, including Velcro, glues, magnets, pins, safety pins lanyards, hooks, hinges, elastic, and varying other approaches known to one of skill in the art. The arrangement of the linear channels 1405, 1505, the riders 1410, 1510, and the attachment mechanisms 1420, 1520 can allow adjustable attachment of the alignment aid 1000 with an object, as will be discussed in more detail further in this disclosure.

Figure 3:
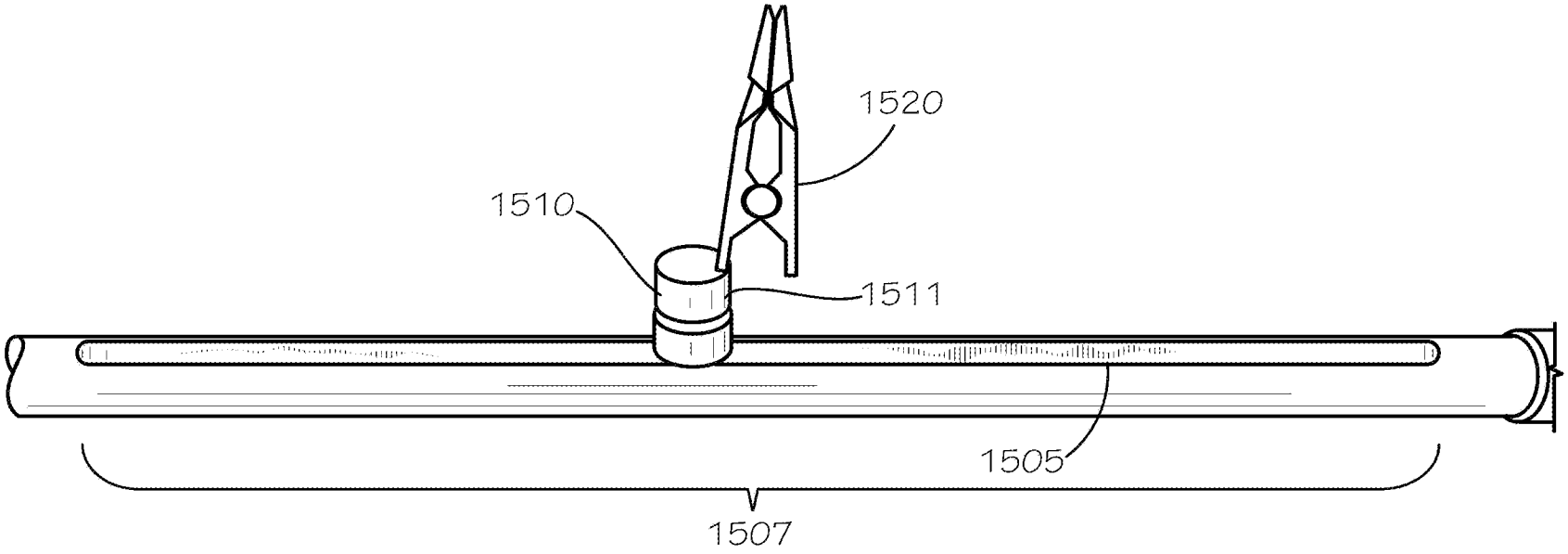
FIG. 3 is a detail view of an attachment mechanism of the alignment aid of FIG. 1.

With reference to FIG. 3, the rider 1510 can be a bearing or other movable element. The attachment mechanism 1520 can be connected to the rider 1510 by various adhesives, tape, mechanical means such as clamping, screws, welding, or the attachment mechanism 1520 can be integral to the rider 1510. In the current aspect, the rider 1510 can include an internal element (not pictured) that connects to an external element 1511 to form the rider 1510. In such an arrangement, the internal element (not pictured) can be of a size large enough to avoid being pulled through the linear channel 1505. The currently described arrangement of rider 1510, linear channel 1505, and attachment mechanism 1520 is but one of many varying arrangements that would be understood by one of skill in the art. Additionally, rider 1410, linear channel 1405, and attachment mechanism 1420 can be similarly arranged and operated as described herein with reference to rider 1510, linear channel 1505, and attachment mechanism 1520, as would be understood by one of skill in the art.

Although linear channels 1405, 1505 and riders 1410, 1510 are described in the current aspect, one of skill in art would understand that multiple arrangements of adjustable connection would be included within the scope of the current disclosure. For example, in various aspects, attachment mechanisms 1420, 1520 can be connected to buttons or female snaps for connection to button holes or male snaps, respectively. In various aspects, attachment mechanisms 1420, 1520 can be connected to zippers, sliders, spring buttons, or other mechanical configurations to allow movable arrangement of the attachment mechanisms 1420, 1520.

With returning reference to FIG. 1, the central joint section 1300 can comprise a joint 1310. In various aspects, the joint 1310 can be omitted from the joint section 1300. In various aspects, the joint section 1300 can be integrally formed with the first central section 1400 and the second central section 1500. In various aspects, the joint 1310 can be a mechanism for connection of the first central section 1400 with the second central section 1500. In the current aspect, the joint 1310 can be a hinge 1710 (seen with reference to FIG. 5) that is fixedly connected to each of the first central section 1400 and the second central section 1500. The hinge 1710 of the joint 1310 allows the first central section 1400 to bend or rotate with respect to the second central section 1500. In various aspects, the joint 1310 can be disconnectable. In various aspects, the joint 1310 can be a threaded arrangement. In various aspects, the joint 1310 can be mechanically locked by additional mechanical means not disclosed herein but known to one of skill in the art. In various aspects, the joint 1310 can be removably fixed by magnetic interaction of a magnetic lock element. One of skill in the art would understand that various clips, clamps, and connection mechanisms can be used without departing from the scope of the current disclosure.

Figure 4:
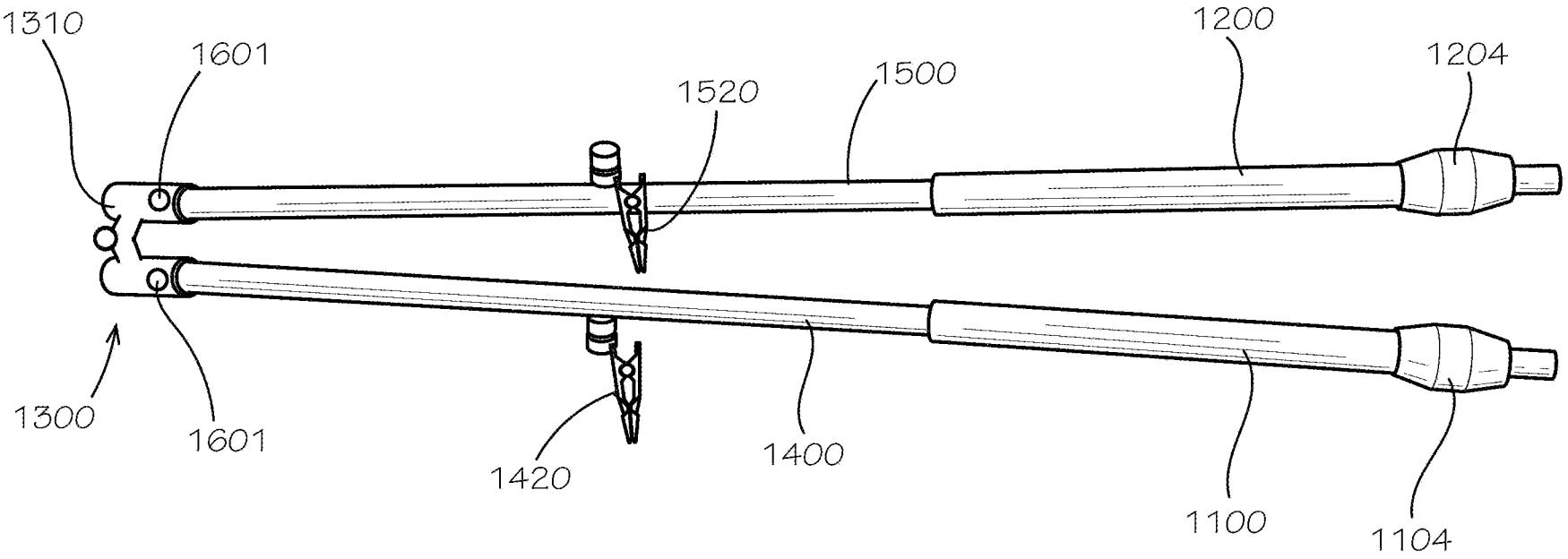
FIG. 4 is a side view of the alignment aid of FIG. 1 in a closed arrangement.

As seen with reference to FIG. 4, the joint 1310 can allow the alignment aid 1000 to collapse by hinging the first central section 1400 with the second central section 1500. It can also be seen that each of the central sections 1400, 1500 can be connected to the joint section 1300 by a screw 1601. As mentioned previously, the connection between the central sections 1400, 1500 can be affixed by various methods as known to one of skill in the art, including glues, threaded arrangement, welding, integral construction, or various other mechanical methods.

Figure 5:
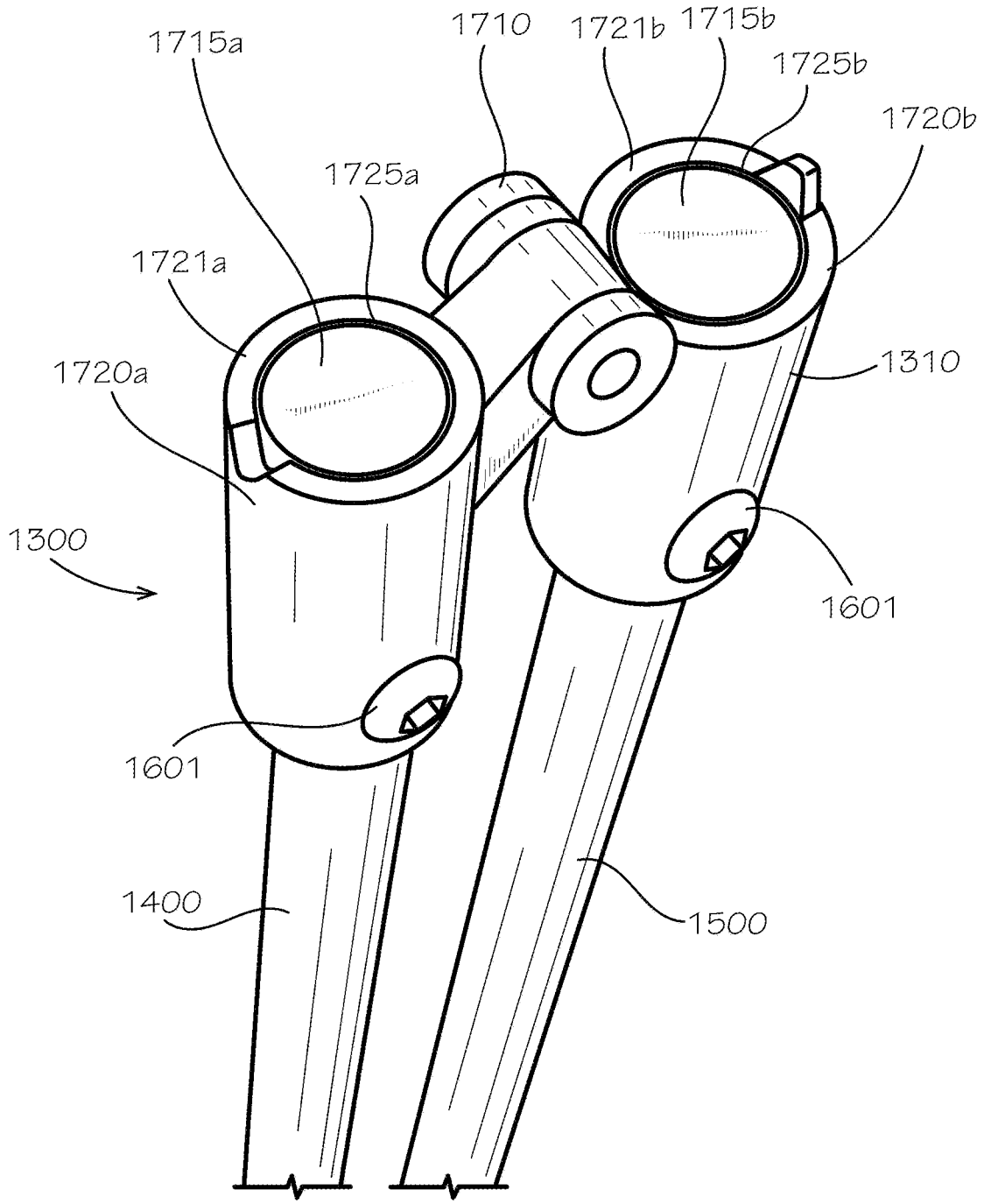
FIG. 5 is a detail perspective view of a joint section of the alignment aid of FIG. 1.

As seen with reference to FIG. 5, in the current aspect, the joint 1310 can be the hinge 1710 with end magnets 1715*a,b* to allow fixing of the joint 1310 without additional moving parts. Such magnetic interaction is the magnetic lock element. Each end magnet 1715*a,b* can be affixed to an end 1721*a,b* of a barrel 1720*a,b* of the joint 1310. The barrel 1720*a,b* can be the part of the joint 1310 connected to the central sections 1400, 1500 by screws 1601. Each end magnet 1715*a,b* can be inserted into a void 1725*a,b* defined in each end 1721*a,b*. When arranged as shown in FIG. 5, the end magnets 1715*a,b* can assist in maintaining the alignment aid 1000 in the opened arrangement of FIG. 1 by asserting magnetic force on the joint 1310. In the opened arrangement of FIG. 1, each end magnet 1715*a,b* can be in contact with the other end magnet 1715*b,a*, respectively, such that the end magnets 1715*a,b* can assert magnetic force on one another. However, such arrangement can be releasable by overcoming the magnetic force of the end magnets 1715*a,b*. and manually hinging the alignment aid 1000 along the joint 1310. By doing such, the alignment aid 1000 can be arranged in the collapsed arrangement of FIG. 4, thereby making it more easily transportable.

Figure 7:
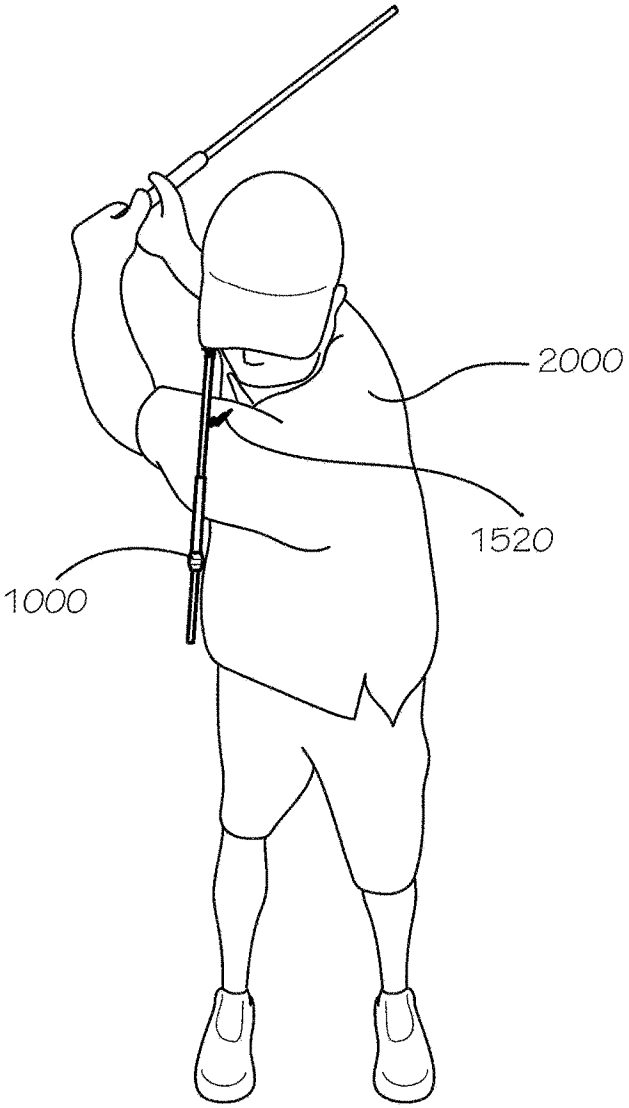
FIG. 7 is a front perspective view of a golfer in a backswing position using the alignment aid of FIG. 1.
Figure 6:
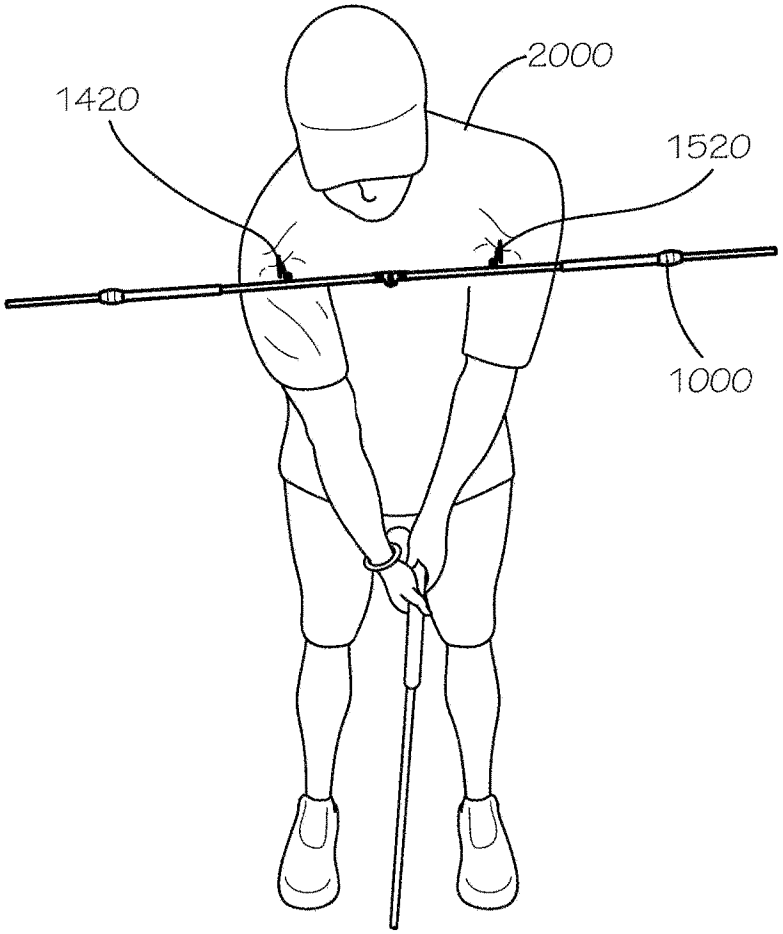
FIG. 6 is a front perspective view of a golfer in an address position using the alignment aid of FIG. 1.

As seen with reference to FIGS. 6-7, in use, the alignment aid 1000 can be attached to a golfer's 2000 clothing for practice to assist in aligning various parts of the golfer's body with the desired target. Proper alignment of a golfer includes aligning the shoulders, hips, knees, and feet all toward a common target. When the one of the four elements is out of alignment, golfers will struggle with miscues and errant shots even on swings that do not include other mechanical failures.

The alignment aid 1000 can first be arranged in the opened arrangement of FIG. 1. The alignment aid 1000 can be attached to a golfer's 2000 body by connecting the attachment mechanisms 1420, 1520 to a location on the golfer's 2000 clothing. For example, if the golfer 2000 would like to check shoulder alignment, the golfer 2000 can then connect the attachment mechanisms 1420, 1520 to his or her shirt near the shoulders. The golfer 2000 can then adjust his or her shoulders using the reference of the alignment aid 1000 to align toward the desired target to understand the positioning of his or her body that achieves alignment. If the golfer 2000 wishes to check his or her hip alignment, the golfer 2000 can connect the attachment mechanisms 1420, 1520 to the front of his or her pants. The golfer 2000 can then visually align his or her hips using the reference of the alignment aid 1000 to understand what proper alignment feels like. If the golfer 2000 wishes to check his or her knee alignment, the golfer 2000 can use the attachment mechanisms 1420, 1520 to connect to his or her pants or legs proximate the knees. In various arrangements, leg cuffs can be provided as part of the attachment mechanisms 1420, 1520 to allow easier connection to the knee area. The golfer 2000 can then check his or her knee alignment using the reference of the alignment aid 1000. If the golfer 2000 wishes to check his or her foot alignment, the alignment aid 1000 can be placed on the ground aligning toward to the desired target, and the golfer 2000 can align his or her feet along the line to the target using the reference of the alignment aid 1000. If the golfer 2000 wishes to check more than one body alignment reference at a time, the golfer may utilize multiple alignment aids 1000 connected to his or her body at the same time. The alignment aid 1000 can also be used as a reference for the golfer's 2000 shoulder turn, as seen with specific reference to FIG. 7.

Because the riders 1410, 1510 can be movable within the linear channels 1405, 1505, the alignment aid 1000 can accommodate varying sizes of golfers 2000 and varying locations on the body. For example, the golfer's 2000 knees are typically set wider than the golfer's 2000 shoulders, and the attachment mechanisms 1420, 1520 can be set at any width along the linear channels 1405, 1505 to accommodate the variance in width. Additionally, if the golfer 2000 desires a more extended view of the alignment to a target, the end elements 1102, 1202 can be extended out of the end sections 1100, 1200 to provide a further view of the golfer's 2000 alignment.

Finally, when usage is complete, the alignment aid 1000 can be placed into the collapsed arrangement of FIG. 4 by hinging the central sections 1400, 1500 with respect to each other along the joint 1310. The collapsed arrangement of FIG. 4 can be completed by retracting the end elements 1102, 1202 within the end sections 1100, 1200, respectively, and securing the pole clamps 1104, 1204, respectively. The alignment aid 1000 can then be easily transported in the collapsed arrangement.

As such, the alignment aid 1000 allows a simple and consistent alignment reference that can be used at multiple points along the golfer's 2000 body without the need for additional elements—such as added tape, glue, or pins. Additionally, the golfer 2000 can check many different alignment elements at once, a feature not possible with prior alignment sticks or methods used of checking alignment. Further, the alignment aid 1000 can be easily transported and easily reconfigured from an opened arrangement to a collapsed arrangement with only a few easy steps, thereby making it simple to set up, simple to use, and simple to transport between uses.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An alignment aid comprising:

a central section, the central section being linear; and an attachment mechanism connected to the central section, wherein the attachment mechanism is movably connected to the central section, wherein the central section is hollow and wherein the attachment mechanism is movably connected to the central section within a linear channel defined in the central section, wherein the attachment mechanism is a spring clamp, wherein the central section comprises a first central section and a second central section, wherein the first central section is connected to the second central section by a joint, wherein the joint comprises a hinge, wherein the joint comprises a first barrel fixedly connected to the first central section and a second barrel fixedly connected to the second central section, wherein each barrel is connected to the hinge, wherein each barrel comprises an end, wherein each end defines a void, and wherein each void contains at least one magnet.

2. The alignment aid of claim 1, wherein the first central section is connected to a first end section and wherein the second central section is connected to a second end section.

3. The alignment aid of claim 2, wherein the first end section comprises a first end element releasably secured to the first end section by a clamp, wherein the second end section comprises a second end element releasably secured to the second end section by a clamp.

4. The alignment aid of claim 3, wherein the alignment aid comprises a tip connected to each end element.

5. An alignment aid comprising a joint section;

a first central section connected to the joint section, the first central section being hollow and defining a first linear channel;

a second central section connected to the joint section, the second central section being hollow and defining a second linear channel;

a first rider movably arranged within the first linear channel, the first rider connected to a first attachment mechanism;

a second rider movably arranged within the second linear channel, the second rider connected to a second attachment mechanism;

a first end section connected to the first central section; and a second end section connected to the second central section, wherein the joint section comprises a hinge.

6. The alignment aid of claim 5, wherein a first end element is releasably connected in telescoping arrangement to the first end section and wherein a second end element is releasably connected in telescoping arrangement to the second end section.

7. The alignment aid of claim 6, wherein the first end element is releasably connected to the first end section by a first clamp and wherein the second end element is releasably connected to the second end section by a second clamp.

8. The alignment aid of claim 7, wherein the first clamp is a pole clamp and wherein the second clamp is a pole clamp.

9. The alignment aid of claim 5, wherein the joint comprises a magnetic lock element.

10. A method of using an alignment aid for aligning a golfer's body toward a target, the golfer wearing clothing, the method comprising:

obtaining an alignment aid, the alignment aid comprising:

a joint section;

a first central section connected to the joint section, the first central section being hollow and defining a first linear channel;

a second central section connected to the joint section, the second central section being hollow and defining a second linear channel;

a first rider movably arranged within the first linear channel, the first rider connected to a first attachment mechanism; and a second rider movably arranged within the second linear channel, the second rider connected to a second attachment mechanism;

connecting the first attachment mechanism to a first portion of the golfer's clothing;

connecting the second attachment mechanism to a second portion of the golfer's clothing; and, aligning the alignment aid toward a target.

* * * * *